US006189225B1

(12) United States Patent
Jansson

(10) Patent No.: US 6,189,225 B1
(45) **Date of Patent: *Feb. 20, 2001**

(54) ANGLE GAUGE FOR GRINDING SHARP-EDGED TOOLS

(75) Inventor: Torgny Jansson, Lindesberg (SE)

(73) Assignee: Tormek AB, Lindesberg (SE)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/311,668

(22) Filed: May 13, 1999

(30) Foreign Application Priority Data

May 13, 1998 (SE) ..... 9801669

(51) Int. Cl.[7] ..... B27G 23/00; G01B 5/24
(52) U.S. Cl. ..... 33/534; 33/613; 33/628
(58) Field of Search ..... 33/534, 613, 626, 33/628, 633, 530, 531, 532

(56) References Cited

U.S. PATENT DOCUMENTS 246,625 * 9/1881 Merrill ..... 33/633
2,468,395 * 4/1949 Fredin ..... 33/628
3,252,223 * 5/1966 Gettel ..... 33/633
3,298,106 * 1/1967 Duvall ..... 33/628
3,482,325 * 12/1969 Mitchell ..... 33/628
5,611,149 * 3/1997 Fujiwara ..... 33/534

* cited by examiner

*Primary Examiner*—Christopher W. Fulton
(74) *Attorney, Agent, or Firm*—John Lezdey & Assoc

(57) ABSTRACT

Angle gauge for grinding the lip of sharp-edged tools whereby an adjustable first device is arranged on the frame at one end of the frame that during measurement is intended to be supported against the periphery of the grinding wheel and that through adjustment varies the distance between the said one end and the periphery of the grinding wheel, and an adjustable and rotatable second device is arranged at the other end of the frame and provided with a flat edge that extends towards the periphery of the grinding wheel and that during measurement abuts with periphery of the grinding wheel with the corner edge that faces the first device in such a manner that the flat edge forms an angle with the periphery of the grinding wheel where this angle defines the cutting angle.

4 Claims, 2 Drawing Sheets

ANGLE GAUGE FOR GRINDING SHARP-EDGED TOOLS

FIELD OF THE INVENTION

The present invention concerns an angle gauge used when grinding the lip of sharp-edged tools according to the introduction to claim 1.

BACKGROUND OF THE INVENTION

It is of great importance that the lip of sharp-edged tools of various types, such as knives, chisels, etc., has the correct cutting angle in order for the tool to function in the correct way and with good control of its movement without the lip being damaged. The correct cutting angle naturally depends on the quality of the steel, the type of tool, the hardness of the wood and how hard one works with the tool. Experience of these variables determines the angle that is correct for each occasion.

A practical way of setting a certain cutting angle, chosen because of the reasons mentioned above, for grinding the tool has not been available. When grinding tools by hand today, there is only one type of template provided with notches or angular-shaped grooves of different angles in which the lip of the tool can be inserted to determine or estimate the cutting angle.

SUMMARY OF THE INVENTION

With the help of the invention, as is evident from the characteristics sections of the claims, an angle gauge has been devised with which it is possible to rig the tool at the grinding wheel and its holder for grinding to the correct, chosen cutting angle, and with which it is possible to even measure cutting angles found on the tool. With the help of the invention, the adjustment of the tool at the grinding wheel holder to attain the correct cutting angle can be made independent of the diameter of the grinding wheel within, of course, reasonable limits.

DESCRIPTION OF THE PREFERRED EMBODIMENTS

Figure 1:
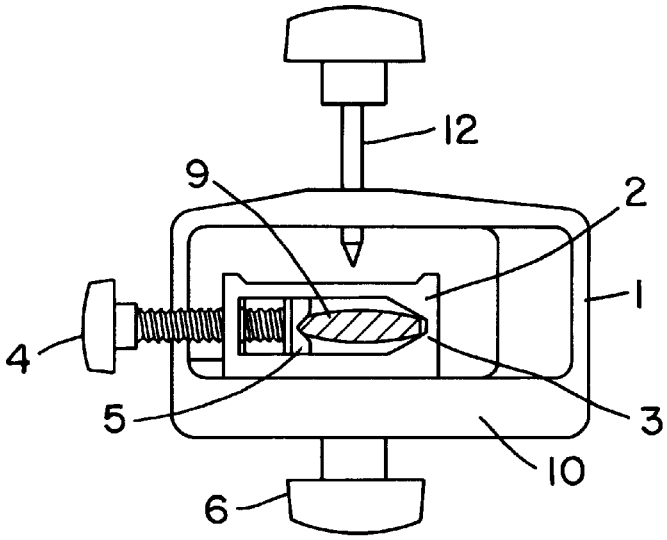
Figure 2:
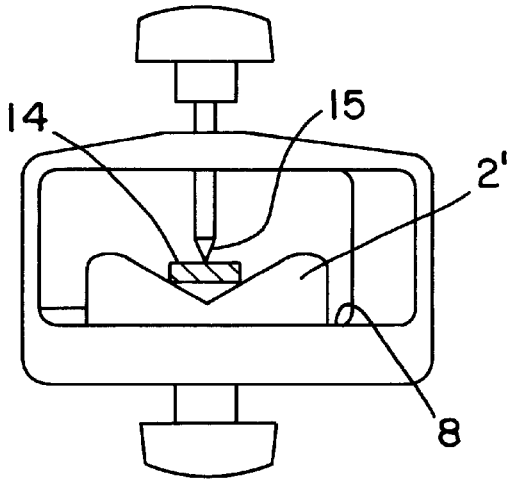
Figure 3:
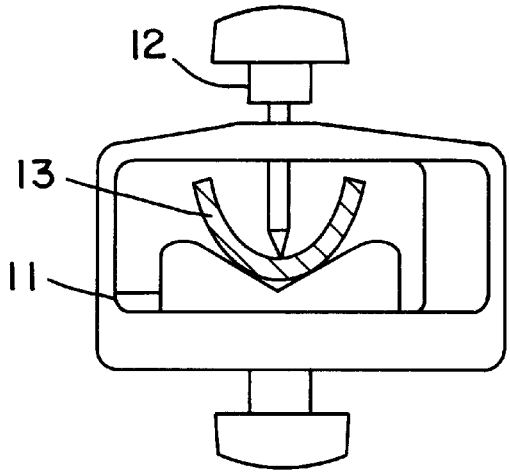

The invention will be described in greater detail with reference to the drawings where FIG. 1 shows the angle gauge according to the invention seen from the side, FIG. 2 shows a tool rigged for grinding with a certain diameter of grinding wheel and FIG. 3 shows a situation equivalent to that shown in FIG. 2 but with a different diameter of grinding wheel.

Figure 4:
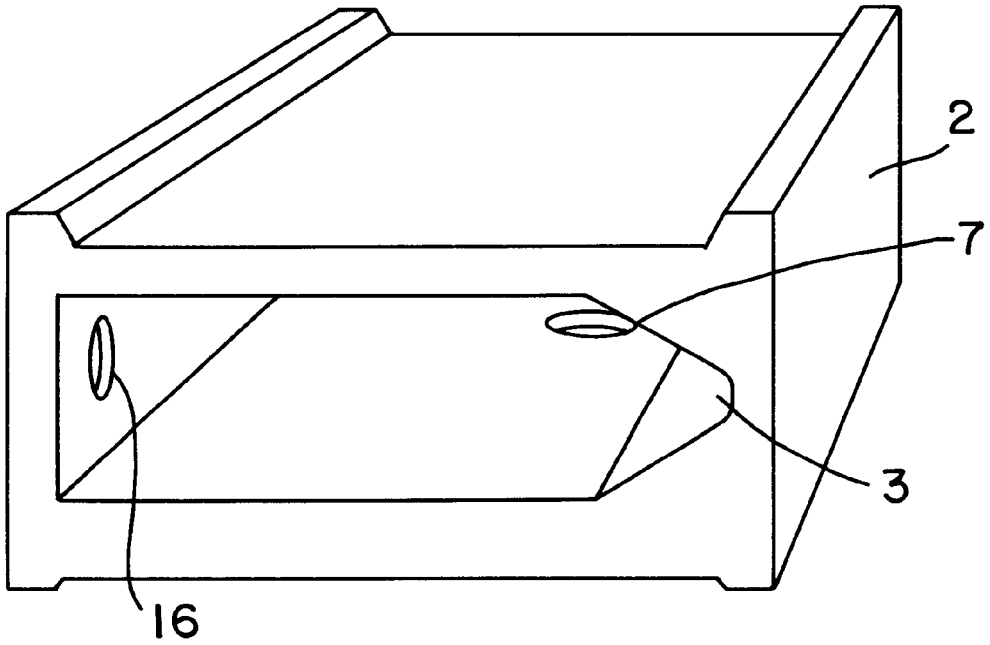
Figure 1:
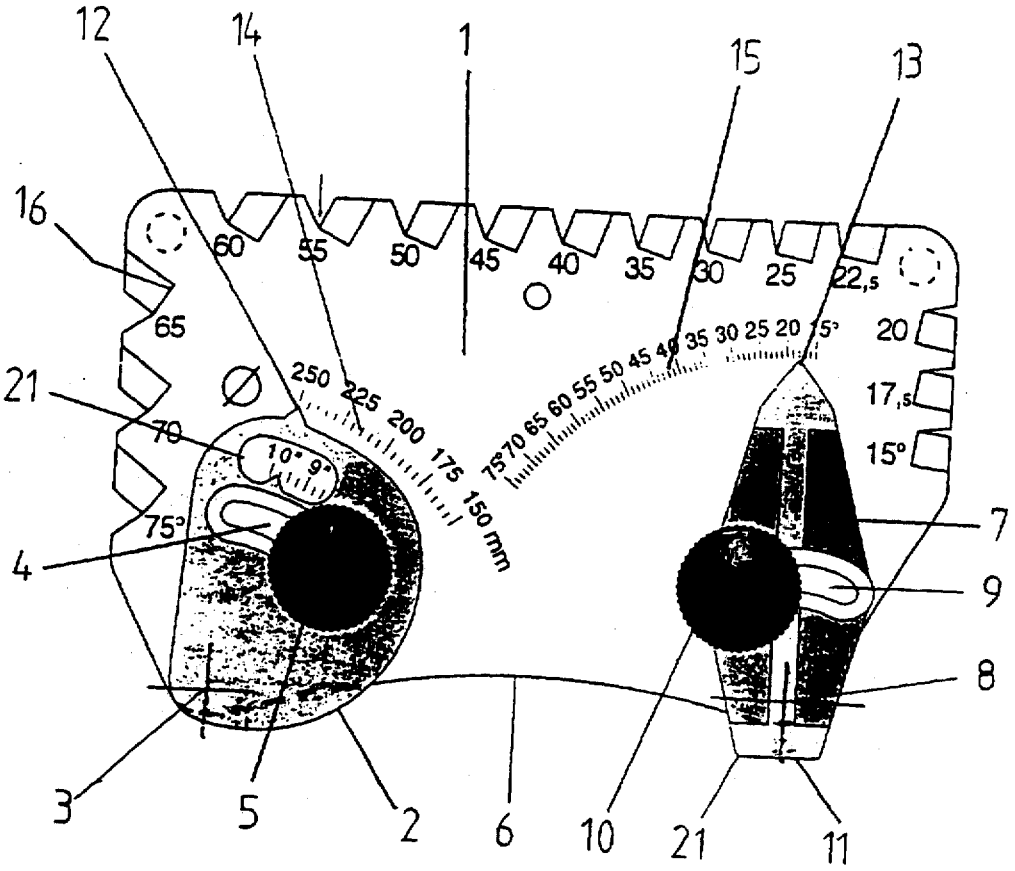
Figure 2:
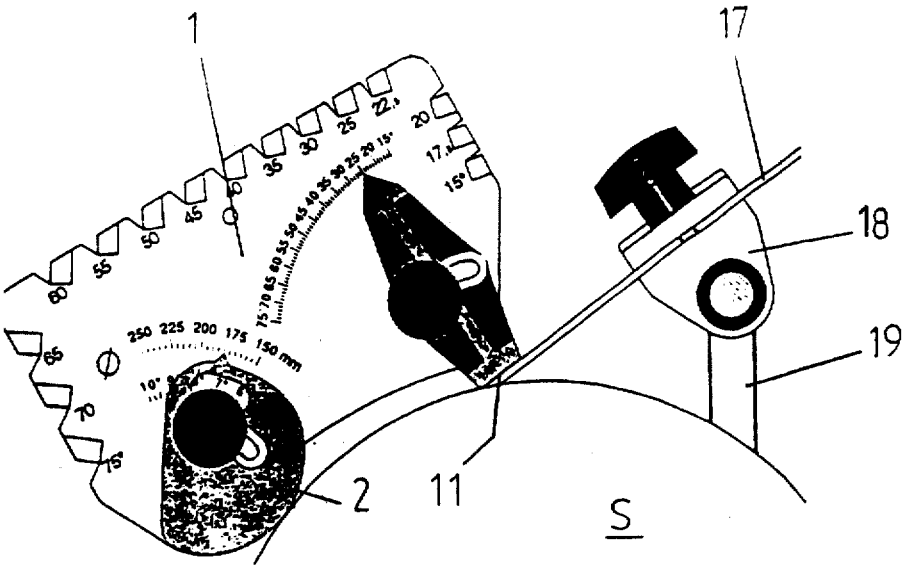
Figure 3:
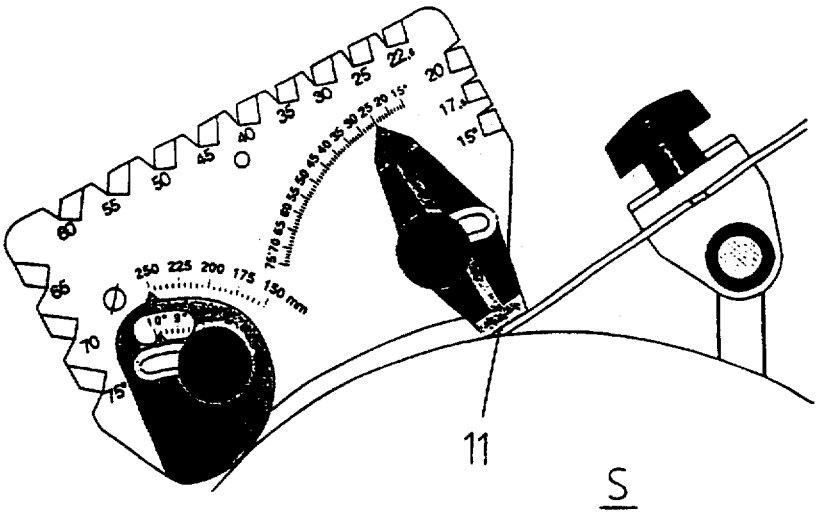
Figure 4:
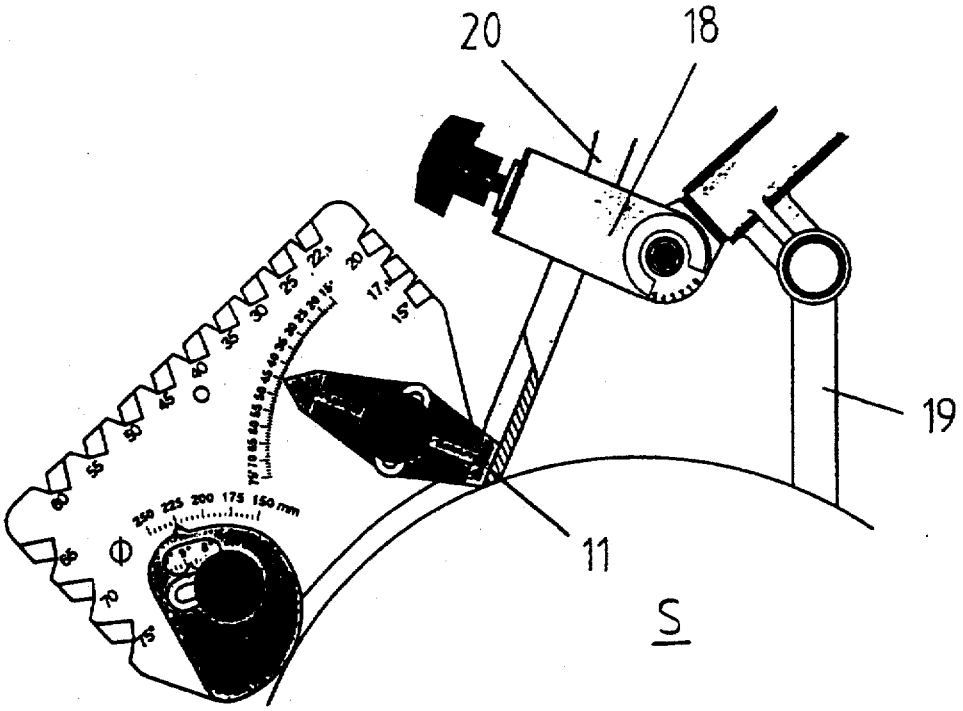

FIG. 4 shows the set-up during the grinding of a gouge.

The angle gauge according to the invention includes a frame 1 with a certain longitudinal extension and a thickness of 3–5 millimeters, for example. At one end of the frame, a first device in the form of a cam plate 2 is arranged. Cam plate 2 is arranged to rotate around point 3 on the frame 1. In addition, cam plate 2 is provided with a slot 4 with its centre of curvature at 3. A locking screw 5 extends through the slot 4, with whose help the cam plate can be locked in position against the frame 1 at different angles of rotation. The edge of the frame 1, which is pointed towards the grinding wheel when the invention is in use, is convex and the cam plate 2 extends out from this edge 6 of the frame 1.

A second device in the form of an elongated body 7 is arranged at the other end of the frame 1. The elongated body 7 is arranged to be rotatable and attached to the frame 1 around point 8. Body 7 also has a slot 9 with its centre of curvature at 8. A locking screw 10 extends through the slot 8, with whose help the elongated body 7 can be locked in position against the frame 1 at different angles of rotation. The elongated body 7 extends out from the edge 6 of frame 1 and has a flat edge 11 at its outer end.

In the example shown in FIG. 1, the cam plate 2 and the elongated body 7 are provided with sharp indicating points 12 and 13 respectively and the frame is provided with scales 14 and 15 respectively. Scale 14 for cam plate 2 is graduated from 150 to 250 millimeters and refers to the diameter of the grinding wheel in question. Scale 15 gives the intended cutting angle.

In addition, frame 1 is provided with a number of sharp pointed notches 16 with different bottom angles for easy checking of the cutting angle of a tool.

FIG. 2 thus shows the grinding of a steel tool 17 clamped in a jig 18 held by a universal support 19. The cam plate 2 is adjusted for grinding with a grinding wheel S with a diameter of 180 millimeters and the body 7 that determines the angle of the cutting angle that is to be ground is adjusted to 25°. FIG. 3 shows grinding with a 25° cutting angle but with a grinding wheel of 250 millimeters diameter.

FIG. 4 shows the equivalent grinding of a gouge 20 to an angle of 45° with a grinding wheel of 225 millimeters diameter. Here, the jig 18 is of another type than that shown in FIGS. 2 and 3 and the gouge is tilted around its longitudinal axis during the grinding.

By allowing the possibility of always being able to compensate for the diameter of the grinding wheel with the help of cam plate 2, the correct cutting angle can always be set with the help of the device 7. The frame 1 with the devices 2 and 7 is brought to abut the grinding wheel S, as shown, with the diameter of the grinding wheel set on cam plate 2 and with the cutting angle set on body 7. The corner edge 21 (FIG. 1) of the flat edge 11 of this body that lies closest to cam plate 2 thereby abuts the grinding wheel S. The tool 17 (20) is now rigged in the grinding wheel support via the jig 18 so that its upper side coincides with the flat edge 11 in the manner shown in FIGS. 2–4. Following this, the angle gauge is removed and the grinding begins. The cutting angle can be checked easily afterwards with the help of the pre-set angle gauge.

As is shown in the figures, the cam plate is provided with a window 22 in which a scale graduated in inches is visible.

What is claimed is:

1. In an angle gauge used when grinding the lip of sharp-edged tools including a frame with a longitudinal extension the improvement which comprises in that an adjustable first device is arranged on the frame at one end of the frame that during measurement is intended to be supported against the periphery of a grinding wheel and that through adjustment varies the distance between the said one end and the periphery of the grinding wheel, and that an adjustable rotatable second device is arranged at the other end of the frame and provided with a flat edge that extends towards the periphery of the grinding wheel and that during measurement abuts the periphery of the grinding wheel with the corner edge that faces the first device in such a manner that the flat edge forms an angle with the periphery of the grinding wheel where this angle defines the cutting angle.

2. The angle gauge according to claim 1 wherein said first device comprises a rotatable cam plate that can be locked against the frame.

3. The angle gauge according to claim 1 wherein said second device has the form of an elongated body that can be locked against the frame and that has one end that extends outward from the frame to form the flat edge.

4. The angle gauge according to claim 1 wherein said first device and the second device comprise sharp indicator points that interact with scales applied on the frame.

* * * * *

UNITED STATES PATENT AND TRADEMARK OFFICE

CERTIFICATE OF CORRECTION

PATENT NO. : 6,189,225 B1
DATED : February 20, 2001
INVENTOR(S) : Torgny Jansson It is certified that error appears in the above-identified patent and that said Letters Patent is hereby corrected as shown below:

Title page,
The Title page should be deleted and substituted therefore the attached Title page.

Drawings,
Delete Drawing sheets 1-4, and substitute therefore the Drawing sheet, consisting of Figs. 1-4, as shown on the attached pages.

Signed and Sealed this

Twenty-third Day of April, 2002

*Attest:*

*Attesting Officer*

JAMES E. ROGAN
*Director of the United States Patent and Trademark Office*

(12) United States Patent
Jansson

(10) Patent No.: US 6,189,225 B1
(45) **Date of Patent: *Feb. 20, 2001**

(54) ANGLE GAUGE FOR GRINDING SHARP-EDGED TOOLS

(75) Inventor: Torgny Jansson, Lindesberg (SE)

(73) Assignee: Tormek AB, Lindesberg (SE)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/311,668

(22) Filed: May 13, 1999

(30) Foreign Application Priority Data

May 13, 1998 (SE) ..... 9801669

(51) Int. Cl.[7] ..... B27G 23/00; G01B 5/24
(52) U.S. Cl. ..... 33/534; 33/613; 33/628
(58) Field of Search ..... 33/534, 613, 626, 33/628, 633, 530, 531, 532

(56) References Cited

U.S. PATENT DOCUMENTS 246,625 * 9/1881 Merrill ..... 33/633
2,468,395 * 4/1949 Fredin ..... 33/628
3,252,223 * 5/1966 Gettel ..... 33/633
3,298,106 * 1/1967 Duvall ..... 33/628
3,482,325 * 12/1969 Mitchell ..... 33/628
5,611,149 * 3/1997 Fujiwara ..... 33/534

* cited by examiner

*Primary Examiner*—Christopher W. Fulton
(74) *Attorney, Agent, or Firm*—John Lezdey & Assoc

(57) ABSTRACT

Angle gauge for grinding the lip of sharp-edged tools whereby an adjustable first device is arranged on the frame at one end of the frame that during measurement is intended to be supported against the periphery of the grinding wheel and that through adjustment varies the distance between the said one end and the periphery of the grinding wheel, and an adjustable and rotatable second device is arranged at the other end of the frame and provided with a flat edge that extends towards the periphery of the grinding wheel and that during measurement abuts with periphery of the grinding wheel with the corner edge that faces the first device in such a manner that the flat edge forms an angle with the periphery of the grinding wheel where this angle defines the cutting angle.

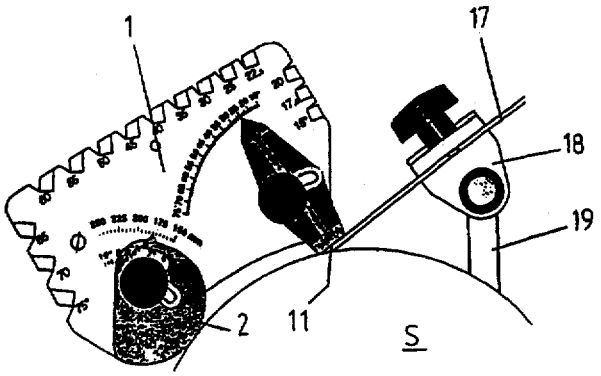

4 Claims, 2 Drawing Sheets